US007631729B2

(12) United States Patent
Tsuchiya et al.

(10) Patent No.: US 7,631,729 B2
(45) Date of Patent: Dec. 15, 2009

(54) RECIPROCATING ELECTRIC COMPRESSOR

(75) Inventors: Koichi Tsuchiya, Kanagawa (JP); Kazuhiro Yokota, Kanagawa (JP); Atsushi Naruse, Kanagawa (JP)

(73) Assignee: Panasonic Corporation, Osaka (JP)

( * ) Notice: Subject to any disclaimer, the term of this patent is extended or adjusted under 35 U.S.C. 154(b) by 606 days.

(21) Appl. No.: 10/687,825

(22) Filed: Oct. 20, 2003

(65) Prior Publication Data

US 2004/0126250 A1 Jul. 1, 2004

(30) Foreign Application Priority Data

Oct. 21, 2002 (JP) ..... 2002-305435

(51) Int. Cl.
*F01M 1/04* (2006.01)
*F04B 39/02* (2006.01)

(52) U.S. Cl. ..... 184/6.5; 417/368; 417/415; 417/902; 184/6.6

(58) Field of Classification Search ..... 417/902, 417/423.13, 368, 415; 184/6.5, 6.6
See application file for complete search history.

(56) References Cited

U.S. PATENT DOCUMENTS 4,478,559 A * 10/1984 Andrione et al. ..... 417/368
4,493,226 A * 1/1985 Andrione et al. ..... 74/598
5,707,220 A * 1/1998 Krueger et al. ..... 417/423.12
5,842,420 A * 12/1998 Khoo et al. ..... 184/6.16
6,457,561 B1 * 10/2002 Goodnight ..... 184/6.16
7,100,743 B2 * 9/2006 Park et al. ..... 184/6.16

FOREIGN PATENT DOCUMENTS

JP 62-44108 9/1987

* cited by examiner

*Primary Examiner*—Devon C Kramer
*Assistant Examiner*—Leonard J Weinstein
(74) *Attorney, Agent, or Firm*—Wenderoth, Lind & Ponack, L.L.P.

(57) ABSTRACT

A reciprocating compressor includes a compressing unit placed over a motor unit. A crankshaft, which converts rotating action of the motor unit into reciprocating action of a piston of the compressing unit, has (a) a centrifugal pump provided at a lower section of the crankshaft, and (b) a pair of spiral pumps that communicate with the centrifugal pump and have leading grooves running in opposite directions to each other. The crankshaft also includes a pair of eccentric paths at its upper section. The eccentric paths open into an enclosed container and communicate with the spiral pumps respectively. This structure allows production of greater force for transferring lubricant oil regardless of the rotating direction of the crankshaft.

19 Claims, 6 Drawing Sheets

RECIPROCATING ELECTRIC COMPRESSOR

FIELD OF THE INVENTION

The present invention relates to reciprocating electric compressors to be used in refrigerating-cycle devices such as a refrigerator having a freezer, a vending machine, and an air-conditioner.

BACKGROUND OF THE INVENTION

A reciprocating electric compressor (hereinafter simply referred to as "compressor") employed in refrigerating-cycle devices such as a refrigerator with a freezer, a vending machine, and an air-conditioner has been required to be highly efficient and reliable. In general, a conventional compressor is equipped with a crankshaft incorporating a lubricator, and a typical one is disclosed in Japanese Patent Publication No. S62-44108. The conventional compressor is described hereinafter with reference to FIG. 8.

FIG. 8 is a sectional view of the conventional compressor. Compressor 1 is housed in enclosed container 2, which accommodates frame 3 in the middle, motor unit 4 at a lower section, compressing mechanism 5 at an upper section. Crankshaft 7 extends through bearing 6 of frame 3. On an outer wall of crankshaft 7, rotor 8 of motor unit 4 is rigidly mounted. Crankshaft 7 has main shaft 70 and eccentric shaft 9, and engages with slider 11 of piston 10 via eccentric shat 9. Piston 10 is an element of compressing mechanism 5.

Slant hole 12 (hereinafter referred to simply as "hole") slantingly extends from the bottom of crankshaft 7 to the lower end of bearing 6 through crankshaft 7, and opens onto the outer wall of shaft 7. Hole 12 has a rather small diameter.

A part of crankshaft 7 rests within bearing 6, and on this resting section, spiral pump 14 (hereinafter referred to simply as "pump") is formed. Pump 14 comprises a single leading groove which communicates with lateral hole 13 at its lower end and vertical hole 15 formed in eccentric shaft 9 at its upper end. Vertical hole 15 opens into an inner space of container 2 at its upper end, and communicates with the slide face of thrust-bearing 16 at its lower end. Lubricant oil 17 is pooled in the lower section of container 2, and crankshaft 7 dips therein at its lower end.

An operation of the foregoing conventional reciprocating compressor is described hereinafter. When motor unit 4 is turned on, rotor 8 starts spinning, which causes crankshaft 7 to rotate. Rotation of crankshaft 7 reciprocates piston 10 engaging with eccentric shaft 9 via slider 11, so that compression is carried out. Lubricant oil 17 rises from the lower end of crankshaft 7 through slanted hole 12 due to centrifugal force, and moves upward via lateral hole 13 to pump 14 of main shaft 70, which then transmits lubricant oil 17 to bearing 16 and eccentric shaft 9, and then lubricant oil 17 is discharged into the space within container 2.

As such, lubricant oil 17 rises through hole 12, which extends slantingly and upward from the lower end of shaft 7, due to centrifugal force, and pump 14 formed of the one-way leading groove from lateral hole 13 transfers lubricant oil 17 to the slide section of bearing 16, where lubricant oil 17 performs lubricating action. A winding direction of the leading groove is determined on the premise that pump 14 operates in a given rotating direction. Therefore, if pump 14 operates in a direction opposite to the given one, a downward force is created by pump 14, so that no lubricant oil is supplied to the upper section of bearing 6. As a result, bearing 6 incurs abnormal abrasion, which causes a breakdown. For instance, in the case of a reciprocating compressor which employs a three-phase induction motor as the motor unit, it can be inversely rotated due to incorrect wiring. Thus a plugging relay needs to be integrated into the circuit for preventing the breakdown due to the reverse rotation; however, since the relay is so expensive, the cost of the compressor is obliged to increase.

There is another conventional reciprocating compressor which employs a single-phase and resistant-start induction motor using a PTC relay as a starter. In this compressor, when an instantaneous power interruption occurs, which does not give a recovery time to the PTC relay, the piston is pushed back due to the pressure of a compressed room. If the power is recovered during this reverse rotation, the compressor is kept rotating inversely. In this case, the lubricator does not work properly, and the slide section incurs a breakdown due to abrasion.

In order to overcome the problems discussed above, a reciprocating compressor equipped with both-way leading grooves has been proposed. This structure allows reversible operation; however, there is still no reciprocating compressor operable in both rotating directions and equipped with a compressing unit, which needs high pump-head for lubrication, over a motor unit.

SUMMARY OF THE INVENTION

The present invention provides a reciprocating compressor equipped with a compressing unit over a motor unit. Rotation of the motor unit is converted into reciprocation of a piston by a crankshaft. The crankshaft includes (a) a centrifugal pump disposed in a lower section, and (b) a pair of functionally independent spiral pumps having two leading grooves which communicate with the centrifugal pump and run in opposite directions to each other. The crankshaft opens into an enclosed container at its upper end, and has a pair of functionally independent eccentric paths (vertical holes) communicating with the spiral pumps respectively.

DETAILED DESCRIPTION OF THE INVENTION

Exemplary Embodiment 1

Figure 1:
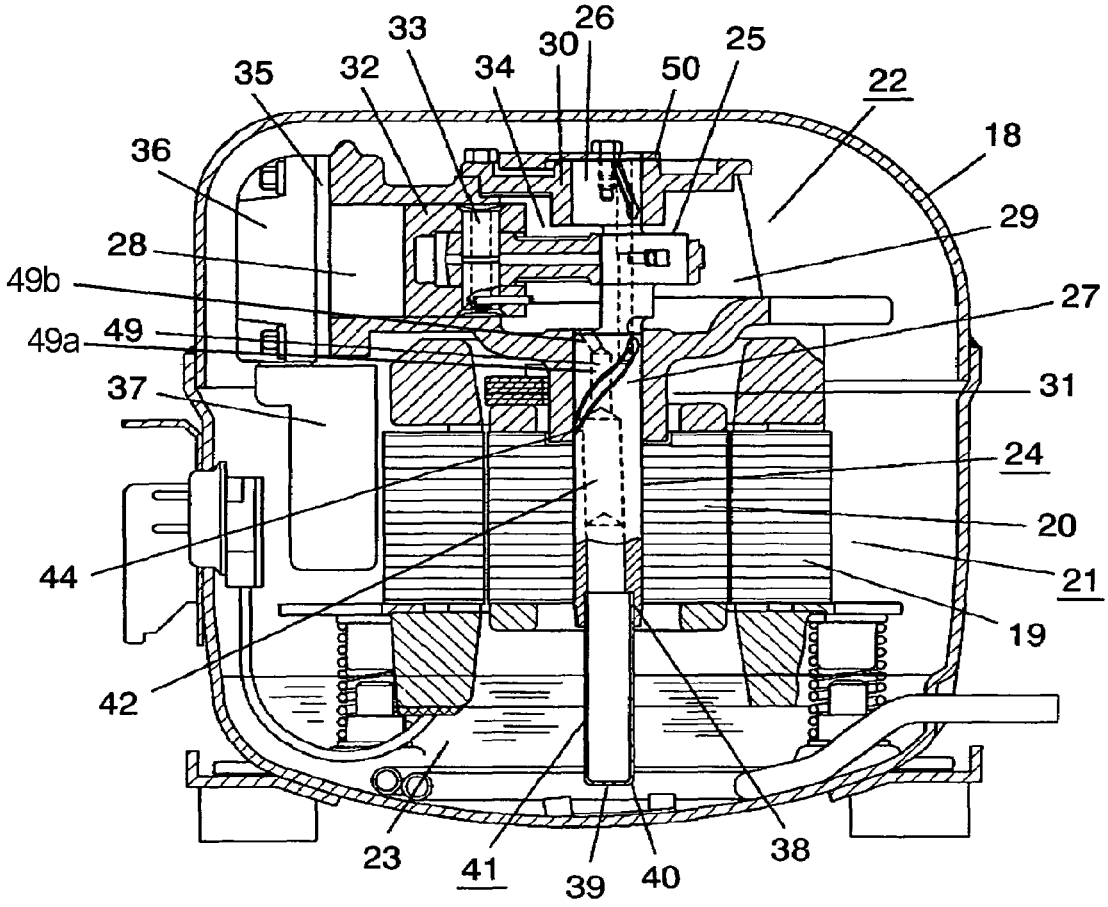
FIG. 1 shows a sectional view of a reciprocating compressor in accordance with a first exemplary embodiment of the present invention.
Figure 2:
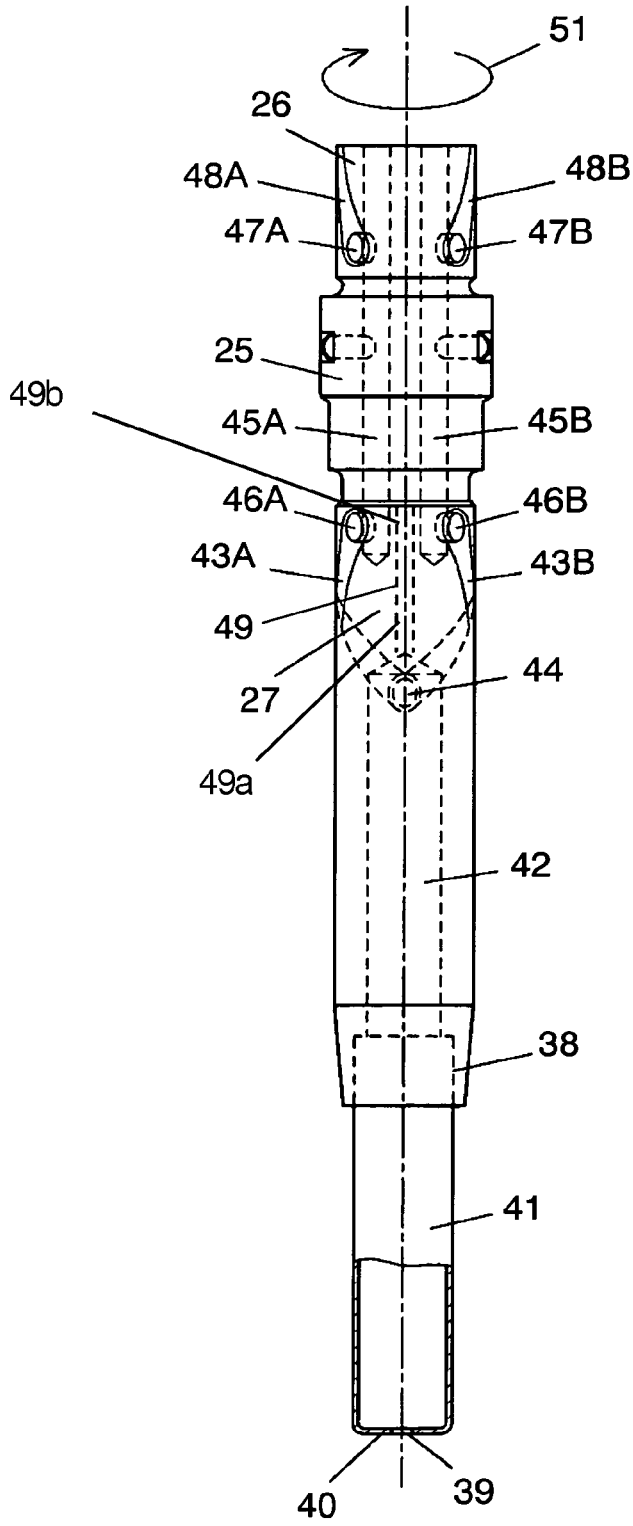
FIG. 2 shows an enlarged view of a crankshaft of the compressor in accordance with the first exemplary embodiment of the present invention.

FIG. 1 shows a sectional view of a reciprocating compressor in accordance with the first exemplary embodiment of the present invention. FIG. 2 shows an enlarged view of a crankshaft of the compressor shown in FIG. 1.

Enclosed container 18 accommodates motor unit 21 comprising stator 19 and rotor 20, and compressing unit 22 driven by motor unit 21. Container 18 pools lubricant oil 23 at its lower section. Motor unit 21 is a three-phase induction motor which allows the compressor, powered by a three-phase power supply, to rotate in both directions regardless of wiring direction.

Compressing unit 22 is detailed now. Crankshaft 24 includes eccentric shaft 25, sub-shaft section 26 and main shaft section 27. Sub-shaft section 26 and main shaft section 27 sandwich eccentric shaft 25 vertically in a concentric manner. Cylinder block 29 includes compression chamber 28, sub-bearing 30 and main-bearing 31. Both of bearings 30 and 31 cross with an axis of compression chamber 28 at approximately right angles, and support sub-shaft section 26 and main-shaft section 27 respectively. Sub-bearing 30 can be disposed independently of cylinder block 29 and can be rigidly mounted to block 29. This structure achieves high pump-head for lubrication and rotation in both directions.

Compression chamber 28 is equipped with piston 32 in a manner that piston 32 is slidable, and piston-pin 33 press-fit into piston 32 is linked to eccentric shaft 25 with a linking section, namely, connecting rod 34. Valve-plate 35 includes an inlet valve and an exhaust valve (both are not shown), and is sandwiched by cylinder head 36 having an exhaust chamber (not shown) therein and cylinder block 29. Suction muffler 37 having an inlet (not shown) is sandwiched by cylinder head 36 and valve plate 35.

Main-shaft section 27 of crankshaft 24 has bottom hole 38 at its lower end. Cap 41 has throttle section 40 at its lower end and is press-fit into main-shaft section 27. Suction hole 39 is prepared at the center of throttle section 40. In main-shaft section 27, slant path 42 extends slantingly and upward from bottom hole 38 such that the center of throttle section 40 is included within the inner wall of path 42, which forms a hollow cylinder. Path 42 is placed such that its upper end reaches a lower section of main bearing 31 and approaches the outer wall of crankshaft 24. As shown in FIG. 2, suction hole 39 has a diameter smaller than a diameter of the hollow cylinder of path 42.

Main-shaft section 27 has spiral pumps 43A, 43B engraved on its outer wall. The pumps include leading grooves running counter to each other and forming helical grooves. Pumps 43A and 43B communicate with slant path 42 at communicating section 44 provided at a lower section of the main shaft. Sections other than communicating section 44 are disposed such that they are independent of each other and free from crossing with each other.

A pair of eccentric paths 45A, 45B stand vertically inside eccentric shaft 25 and sub-shaft section 26 and are independent of each other. Those two paths form vertical holes and communicate with upper ends of pumps 43A, 43B respectively at communicating sections 46A, 46B prepared in an upper section of the main shaft. Upper ends of paths 45A, 45B open on an upper end of sub-shaft section 26 and communicate with the inside of container 18. Sub-shaft section 26 has a pair of spiral pumps 48A, 48B engraved on its outer wall, and those pumps form helical grooves communicating with each other via sub-shaft communicating sections 47A, 47B and paths 45A, 45B. Slant hole 42 has vent hole 49 at its end, and vent hole 42 communicates with the inside of container 18 and opens (via an upper opening) onto the upper end of main-shaft section 27. As shown in FIG. 1, vent hole 49 includes a first part 49*a* that extends upwardly along the rotation axis of the crankshaft 24 from an off-center position with respect to the rotation axis at an upper section of the hollow cylinder of path 42, and a second part 49*b* that extends from an upper end of the first part to the upper opening located at the upper end of the main-shaft section 27. Thrust bearing 50 is rigidly mounted to an end of sub-shaft section 26, and forms a thrust bearing together with sub-bearing 30.

An operation of the foregoing reciprocating compressor is demonstrated hereinafter. When stator 19 of motor unit 21 is powered, rotor 20 starts spinning. In this embodiment, rotor 20 spins along rotating direction 51 viewed down from a top of the compressor.

Rotation of crankshaft 24 causes eccentric shaft 25 to move eccentrically, which reciprocates piston 32 in compression chamber 28 via connecting rod 34 and piston-pin 33. Refrigerant is sucked into chamber 28 via the inlet of suction muffler 37, and compressed. The refrigerant passes through the exhaust valve, cylinder head 36, the exhaust chamber, and is finally discharged to a refrigerating cycle (not shown) outside container 18.

Next, the lubricating operation is demonstrated. Rotation of crankshaft 24 forces lubricant oil 23 to flow into cap 41 via suction hole 39. Lubricant oil 23 then forms a parabolic free-surface in cap 41 due to centrifugal force and counter force to the gravity generated in throttle section 40, and flows to slant path 42 via bottom hole 38.

Since path 42 extends slantingly and upward from bottom hole 38 to form a centrifugal pump, lubricant oil 23 further rises to communicating section 44 due to this centrifugal force. As such, crankshaft 24 includes the centrifugal pump formed of the following two elements: (a) slant path 42 extending upward from the lower end of crankshaft 24 with its axis slanting toward the outer rim of crankshaft 24, and (b) throttle section 40 leading to lubricant oil 23. Thus lubricant oil 23 on the lower end of crankshaft 24 surrounded by throttle section 40 is subject to the centrifugal force due to the rotation of crankshaft 24. Throttle section 40 receives the downward force generated by the centrifugal force, thereby increasing upward force. Further, the slant of path 42 efficiently increases the pump head of lubricant oil 23. As a result, lubricant oil 23 can be transferred by the greater force regardless of the rotating direction.

Since eccentric shaft 25 rotates in direction 51 viewed down from a top of the compressor, lubricant oil 23 flows into pump 43A from communicating section 44. At this time, lubricant oil 23 will not flow into pump 43B because a downward force of pump 43B prevents lubricant oil 23 from flowing into pump 43B.

Pump 43A pushes lubricant oil 23 to rise, so that lubricant oil 23 further gains its pump head in path 45A via communicating section 46A, and then finally discharges and scatters from an upper opening of sub-shaft section 26.

Part of lubricant oil 23 is supplied to eccentric shaft 25 by passing through path 45A, and supplied to sub-shaft section 26 via communicating section 47A. Part of lubricant oil 23 is also supplied to thrust bearing 50 via pump 48A, so that respective sliding sections such as main-shaft section 27, sub-shaft section 26 and eccentric shaft 25 are lubricated.

When rotor 20 rotates counter to rotating direction 51, lubricant oil 23 flows into pump 43B via communicating section 44, and is pushed by pump 43B upward, so that lubricant oil 23 passes through path 45B via communicating section 46B and gains its pump head in path 45B, and then finally discharges and scatters from the opening at the upper end of sub-shaft section 26. Lubricant oil 23 is supplied to sub-shaft section 26 via communicating section 47B, and is also supplied to thrust bearing 50 from pump 48B.

Lubricant oil 23 lifted by the centrifugal pump can thus be supplied to the respective sliding sections regardless of the rotating direction which can be changed by a wiring of the three-phase power supply. As a result, the reciprocating compressor has the compressing unit disposed at its upper section, and is compatible with both rotating directions.

Slant path 42 has hole 49 at its top end, and hole 49 opens onto the upper end of main-shaft section 27 to communicate with the inside of enclosed container 18. This structure allows refrigerant gas generated from lubricant oil 23 to discharge into container 18 via hole 49. As such, the refrigerant gas of lubricant oil 23 existing in the lubricating route of crankshaft 24 can be exhausted, so that obstruction of the lubrication due to gas is reduced. A larger height between the lubricant oil surface in slant path 42 and the opening of hole 49 can prevent lubricant oil 23 from flowing out from hole 49, and this structure allows a relative increase of a pumping-up amount of lubricant oil 23, thereby preparing a sufficient amount of lubricant oil.

Figure 3:
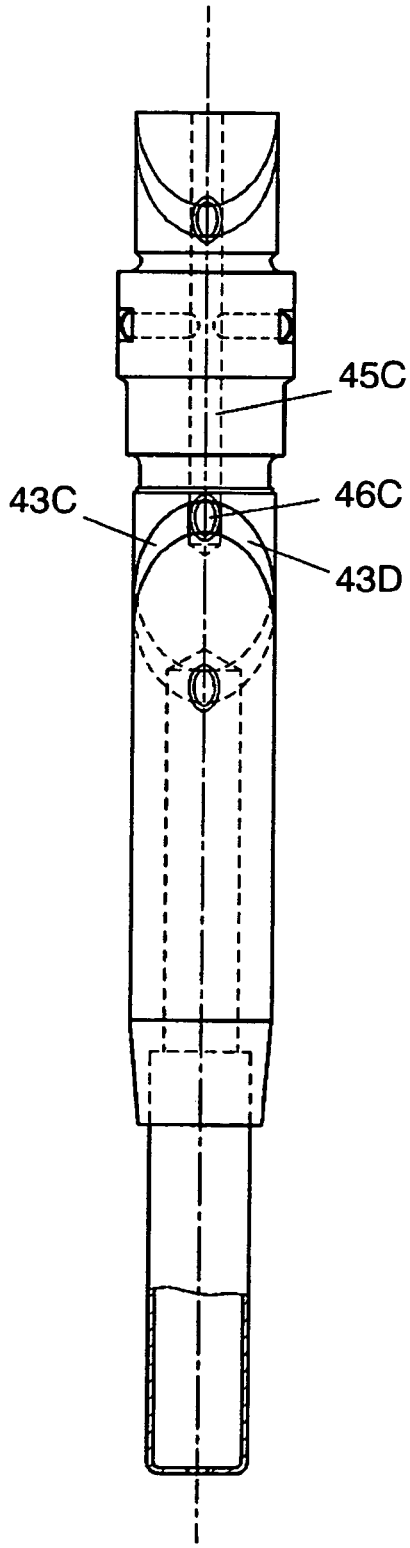
FIG. 3 PRIOR ART
FIG. 3 shows an enlarged view of a conventional crankshaft similar to that of the compressor in accordance with the first exemplary embodiment of the present invention.

Meanwhile, a conventional lubricating mechanism similar to this first embodiment is compared with the foregoing operation. FIG. 3 is an enlarged view of a conventional crankshaft similar to that of the first embodiment. This similar one has the following two different points: (a) This similar crankshaft is engraved with leading grooves of bilateral directions such that spiral pumps 43C and 43D of the main shaft share their outlet. (b) There is one communicating section 46C of the main shaft and there is one eccentric path 45C.

Figure 4:
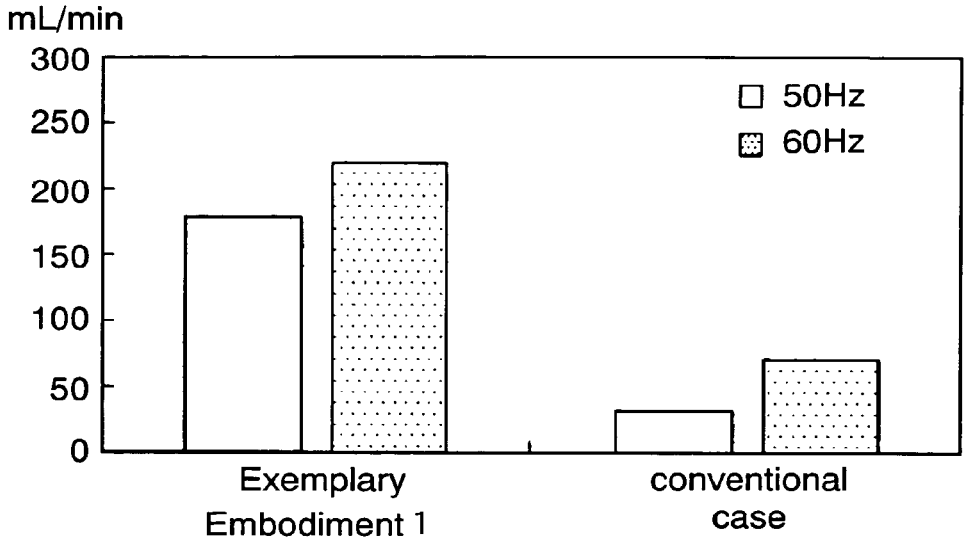
FIG. 4 shows a comparison of amounts of discharged lubricant oil between the compressor used in the first embodiment and a compressor similar to the one used in the first embodiment.

Since pumps 43C and 43D generate pressure to transfer the lubricant oil upward, this similar structure, in which the lubricant oil rises through a single line, i.e., 46C-45C, can be designed as a matter of course. This similar structure, however, discharges substantially less amount of lubricant oil from the top end of crankshaft 24. FIG. 4 shows the comparison between this similar structure and the structure of the first embodiment, namely, the amounts of lubricant oil supplied to both the structures per minute at 50 Hz and 60 Hz of power-supply frequency are compared. The result tells that the structure of the first embodiment can supply much more lubricant oil than the similar structure at both the frequencies.

In this similar structure, leading grooves of bilateral directions communicate with each other at communicating section 46C, so that a closed loop is formed such that parts of lubricant oil 23 drawn-up through a leading groove running along the rotating direction is restored toward the centrifugal pump through a leading groove running counter to the rotating direction. As a result, lubricant oil 23 supplied to eccentric path 45C decreases.

As discussed above, the first embodiment provides a pair of pumps 43A, 43B and a pair of slant paths 45A, 45B, and those pairs form functionally independent systems. This structure allows any pumps active with respect to the rotating direction to transfer lubricant oil 23 upward free from interference from the lubricating paths regardless of rotating directions of crankshaft 24. Thus the pressure for transferring the lubricant oil is not weakened.

Moreover, sub-shaft section 26 has a pair of pumps (helical grooves) 48A, 48B engraved on its outer wall. Pumps 48A, 48B are functionally independent. The pumps are communicated with paths 45A, 45B via communicating sections 47A, 47B. This structure allows sub-bearing 30 to keep holding the lubricant oil regardless of rotating direction.

Exemplary Embodiment 2

Figure 5:
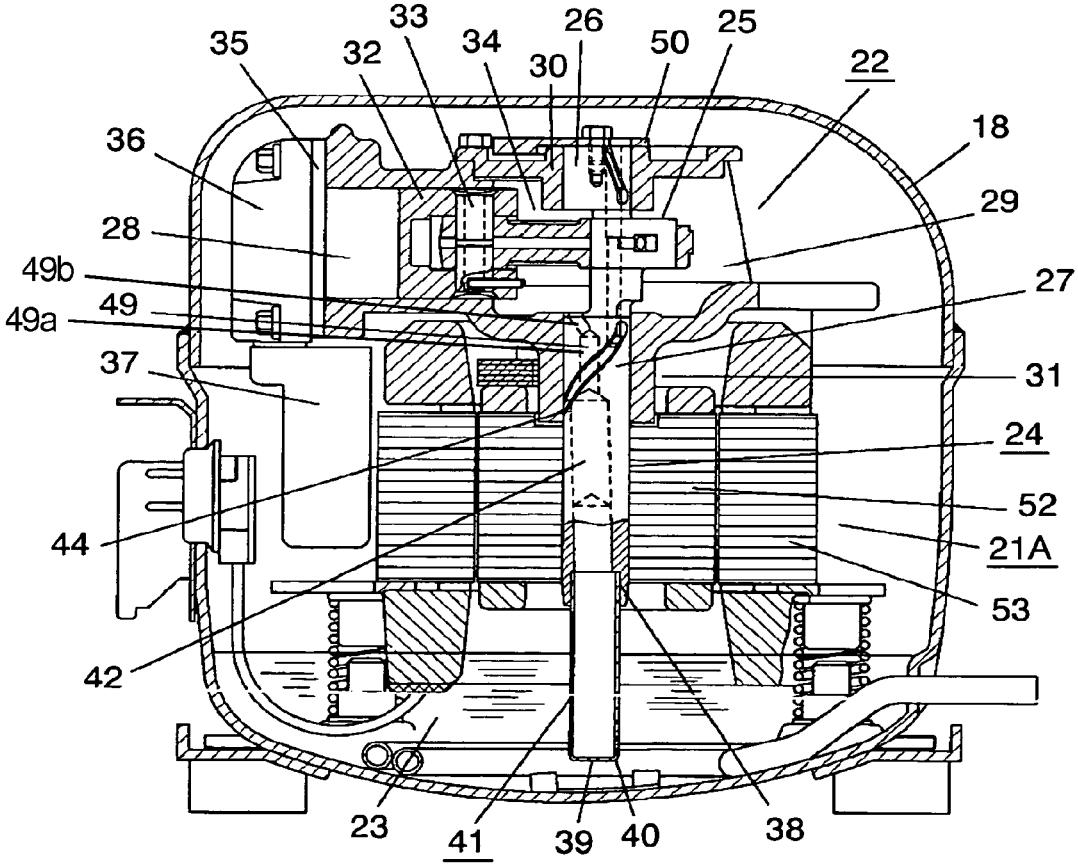
FIG. 5 shows a sectional view of a reciprocating compressor in accordance with a second exemplary embodiment of the present invention.
Figure 6:
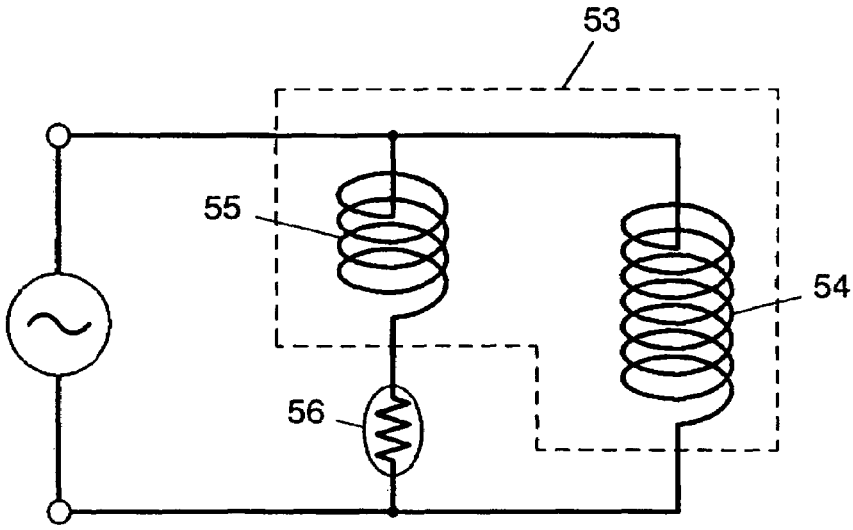
FIG. 6 is a circuit diagram of the compressor in accordance with the second exemplary embodiment of the present invention.
Figure 7:
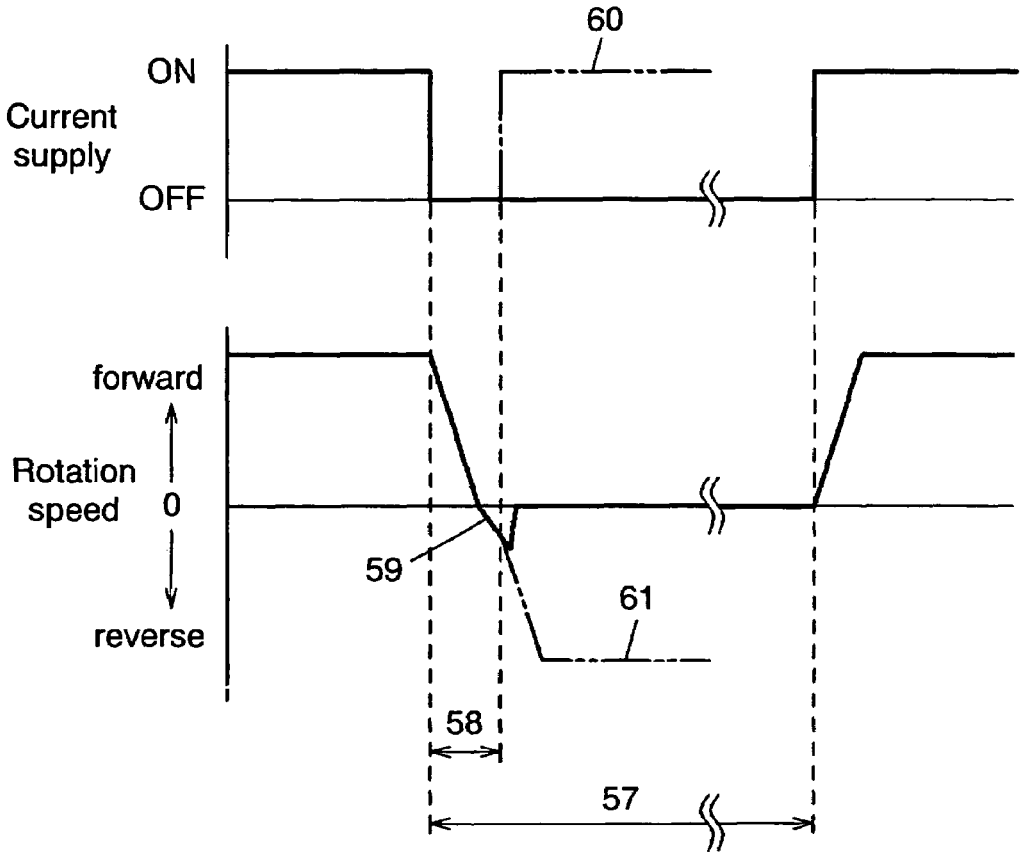
FIG. 7 illustrates an operation of the compressor in accordance with the second exemplary embodiment of the present invention.
Figure 8:
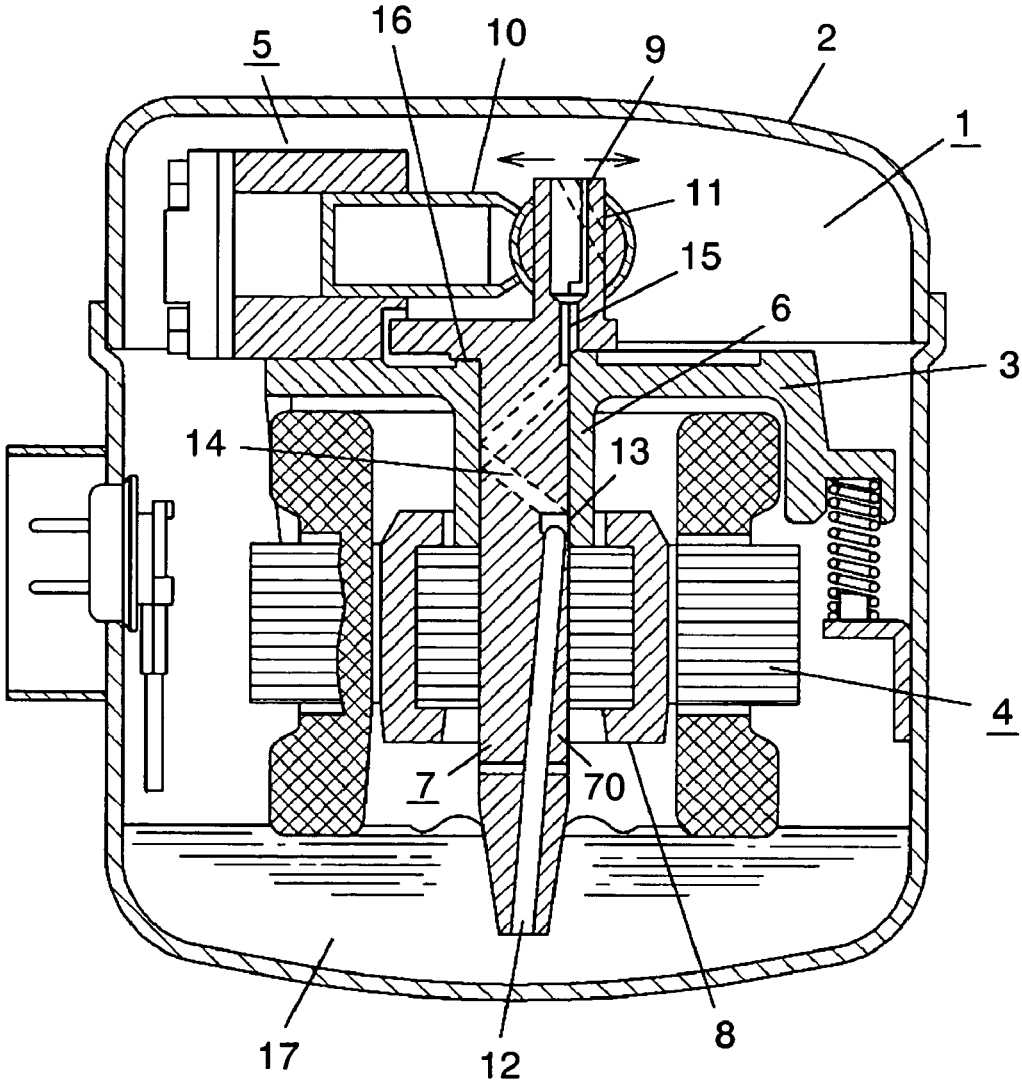
FIG. 8 PRIOR ART
FIG. 8 shows a sectional view of a conventional reciprocating compressor.

FIG. 5 shows a sectional view of a reciprocating compressor in accordance with the second exemplary embodiment of the present invention. FIG. 6 is a circuit diagram of the compressor, and FIG. 7 illustrates an operation of the compressor. The same elements as those in the first embodiment have the same reference marks, and the descriptions thereof are omitted here.

The second embodiment employs a motor unit different from that used in the first embodiment. Motor unit 21A is a single-phase resistant-start induction motor comprising rotor 52 and stator 53. As shown in FIG. 6, in stator 53, main coil 54 and starter coil 55 are coupled with each other in parallel, and PTC relay 56 is coupled with starter coil 55 in series as a starter.

An operation of the foregoing reciprocating compressor is demonstrated hereinafter. Upon energization, starter coil 55 is energized with the resistance of an element of PTC relay 56, and starting torque occurs in a given rotating direction for starting the operation. The element of PTC relay 56 sharply increases its resistance in one second after the start due to self-heating. Starter coil 55 is thus interrupted, and the current runs through only main coil 54 to keep the compressor operating. When the operation is halted, starter coil 55 needs to be energized for re-starting the operation. For that purpose, the element of PTC relay 56 needs cooling time 57 for reducing the resistance. If the cooling time is too short, the element of PTC relay 56 still remains in high-resistance state, and starter coil 55 cannot be energized, so that the compressor does not start.

In such a case, i.e., when the starter torque does not occur, if some external force is applied and it works as the starter torque, rotor 52 rotates along the direction of the external force. To be more specific, as shown in FIG. 7, instantaneous power interruption 58 shorter than one second happens. For instance, if piston 32 stops at a timing of just before the top dead center, piston 32 is pushed back by the pressure in compression chamber 28, so that inverse rotation 59 occurs. During this inverse rotation, if energization 60 is restored, operation 61 is maintained with the inverse rotation kept going.

However, as described in the first embodiment, the reciprocating compressor in accordance with the present embodiment can achieve steady lubrication regardless of the rotating direction. Therefore, if the compressor falls into an abnormal operation as discussed above, it never incurs a breakdown due to abrasion, so that the compressor is proved highly reliable.

The foregoing discussion proves that the present invention can achieve steady lubrication regardless of the rotating direction, and provide a reliable compressor.

What is claimed is:

1. A reciprocating compressor comprising:

(a) a motor unit;

(b) a compressing unit disposed over said motor unit and including:

(b-1) a compression chamber;

(b-2) a piston disposed for reciprocation in said compression chamber; and (b-3) a crankshaft rotatable about a rotation axis and configured to convert rotating action of said motor unit into reciprocating action of said piston; and (c) an enclosed container accommodating said motor unit and said compressing unit and having a lubricant oil pooling portion configured to pool lubricant oil, wherein said crankshaft includes:

(b-3-1) a centrifugal pump disposed at a lower section of said crankshaft and opening into the lubricant oil pooling portion of said container; and (b-3-2) a pair of spiral pumps, functionally independent, disposed at a middle section of said crankshaft, fluidically connected with said centrifugal pump, and having leading grooves running in opposite directions to each other, wherein said spiral pumps respectively have upper ends and lower ends, and said centrifugal pump is fluidically connected with said spiral pumps only at said lower ends thereof via one communicating section, wherein a pair of vertical holes, functionally independent, are provided at an upper section of said crankshaft, said vertical holes respectively having upper ends and lower ends, said upper ends of said vertical holes opening into said container through an uppermost end surface of said crankshaft, said lower ends of said vertical holes being connected to said spiral pumps to fluidically connect said vertical holes with said spiral pumps, respectively, wherein said centrifugal pump includes a throttle section provided with a bottom wall having a suction hole, disposed in said lubricant oil pooling portion, for allowing the lubricant oil pooled in said container to be drawn into said centrifugal pump, said bottom wall being perpendicular to said rotation axis of said crankshaft, wherein said centrifugal pump further includes a hollow cylinder extending upward from a lower end of said crankshaft, wherein said suction hole has a diameter smaller than a diameter of said hollow cylinder, wherein said crankshaft comprises an eccentric shaft, and a main-shaft section provided under the eccentric shaft, wherein said hollow cylinder is inclined with respect to said rotation axis of said crankshaft, wherein a vent hole is provided at an upper section of said hollow cylinder, and wherein said vent hole is formed of a first part and a second part, said first part extends upwardly along said rotation axis of said crankshaft from an off-center position with respect to said rotation axis of said crankshaft at an upper section of said hollow cylinder, and said second part extends from an upper end of said first part to an upper opening that opens into said container and is located at an upper end of said main-shaft section.

2. The reciprocating compressor of claim 1, wherein said crankshaft further comprises a sub-shaft section, said eccentric shaft being vertically sandwiched by said sub-shaft section and said main-shaft section, wherein said compressing unit includes a sub-bearing and a main-bearing, both of which are formed to cross with an axis of said compression chamber at substantially right angles, for supporting said sub-shaft section and said main-shaft section respectively, and a linking section that links said piston to said eccentric shaft.

3. The reciprocating compressor of claim 2, wherein a pair of helical grooves, functionally independent, are provided on an outer wall of said sub-shaft section, said helical grooves including leading grooves running in opposite directions to each other and fluidically connected with the pair of vertical holes respectively, said helical grooves themselves serving to pump the lubricating oil upwardly.

4. The reciprocating compressor of claim 1, wherein said motor unit is a three-phase induction motor.

5. The reciprocating compressor of claim 1, wherein said motor unit is a single-phase resistant-start induction motor.

6. The reciprocating compressor of claim 3, wherein a thrust bearing is provided over said sub shaft section, and said helical grooves provided on said sub-bearing serve to pump lubricant oil up from said vertical holes, respectively, and supply the lubricant oil to said thrust bearing.

7. The reciprocating compressor of claim 1, wherein said throttle section constitutes a lower portion of a cap that is secured to a lower end of said crankshaft; and said suction hole is defined in a bottom end of said cap, and said bottom end of said cap constitutes said bottom wall of said throttle section.

8. The reciprocating compressor of claim 7, wherein said cap is press-fit in said lower end of said crankshaft.

9. The reciprocating compressor of claim 7, wherein said suction hole opens directly between said lubricant oil pooling portion and an interior of said throttle section.

10. The reciprocating compressor of claim 1, wherein said throttle section constitutes a lower portion of a cap that is secured to a lower end of said crankshaft; and said cap comprises a cylinder having a hollow cylindrical interior connecting with said hollow cylinder extending upward from said lower end of said crankshaft, said hollow cylindrical interior of said cap being terminated, at a bottom end thereof, by said bottom wall having said suction hole formed therein.

11. The reciprocating compressor of claim 1, wherein said second part of said vent hole is inclined with respect to said first part of said vent hole.

12. A reciprocating compressor comprising:

an enclosed container having a lubricant oil pooling portion to allow for pooling of lubricant oil therein;

a motor unit disposed in said container;

a compressing unit disposed in said container over said motor unit and being arranged to be driven by said motor unit;

wherein said compressing unit includes a cylinder block, a compression chamber formed in said cylinder block, a piston disposed for reciprocation in said compression chamber, and a crankshaft rotatable about a rotation axis and operably coupled to said piston and said motor unit to cause reciprocation of said piston upon rotating action of said motor unit;

wherein said crankshaft includes a lower, main section coupled with said motor unit, a middle, eccentric section disposed above said main section and coupled to said piston, and an upper, sub-shaft section disposed above said eccentric section;

wherein a lower, mail bearing is provided about said main section of said crankshaft to rotatably support said crankshaft at said mail section thereof;

wherein an upper, sub bearing is provided about said sub-section of said crankshaft to rotatably support said crankshaft at sub-shaft section thereof;

wherein said main section of said crankshaft has a fluid suction path formed therein and opening into said lubricant oil pooling portion of said container;

wherein said main section of said crankshaft has a pair of first spiral pump grooves formed in an outer surface thereof, said first spiral pump grooves being fluidically connected to said fluid suction path and being functionally independent of one another;

wherein said eccentric section of said crankshaft has a pair of vertical holes formed therein, said vertical holes respectively having upper ends and lower ends, said upper ends of said vertical holes opening into said container through an uppermost end surface of said crankshaft, said lower ends of said vertical holes being connected to said first spiral pump grooves to fluidically connect said vertical holes with said first spiral pump grooves, respectively, and said vertical holes being functionally independent of one another;

wherein said first spiral pump grooves respectively have upper ends and lower ends, and said fluid suction path is fluidically connected with said first spiral pump grooves only at said lower ends thereof via one communication section;

wherein said sub-shaft section of said crankshaft has a pair of second spiral pump grooves formed in an outer surface thereof, said second spiral pump grooves being functionally independent of one another and operable to pump the lubricant oil upwardly;

wherein said second spiral pump grooves are fluidically connected to said vertical holes, respectively, such that a first one of said vertical holes is arranged to independently feed lubricant oil from a first one of said first spiral pump grooves to a first one of said second spiral pump grooves, and such that a second one of said vertical holes is arranged to independently feed lubricant oil from a second one of said first spiral pump grooves to a second one of said second spiral pump grooves;

wherein said fluid suction path is defined in a throttle section having a bottom wall with a suction hole therein, disposed in said lubricant oil pooling portion, for allowing the lubricant oil pooled in said container to be drawn into said fluid suction path, said bottom wall being perpendicular to said rotation axis of said crankshaft;

wherein said fluid suction path is further defined in a hollow cylinder extending upward from a lower end of said crankshaft;

wherein said suction hole has a diameter smaller than a diameter of said hollow cylinder, wherein said hollow cylinder is inclined with respect to said rotation axis of said crankshaft, wherein a vent hole is provided at an upper section of said hollow cylinder, and wherein said vent hole is formed of a first part and a second part, said first part extends upwardly along said rotation axis of said crankshaft from an off-center position with respect to said rotation axis of said crankshaft at an upper section of said hollow cylinder, and said second part extends from an upper end of said first part to an upper opening that opens into said container and is located at an upper end of said main-shaft section.

13. The reciprocating compressor of claim 12, wherein said main bearing and said sub bearing have axes that are substantially perpendicular to an axis along which said piston is arranged to reciprocate in said compression chamber.

14. The reciprocating compressor of claim 12, wherein said fluid suction path formed in said main section of said crankshaft constitutes a slant path slanted relative to an axis of said main section of said crankshaft, said slant path constituting a centrifugal pump.

15. The reciprocating compressor of claim 12, wherein said throttle section constitutes a lower portion of a cap that is secured to a lower end of said crankshaft; and said suction hole is defined in a bottom end of said cap, and said bottom end of said cap constitutes said bottom wall of said throttle section.

16. The reciprocating compressor of claim 15, wherein said cap is press-fit in said lower end of said crankshaft.

17. The reciprocating compressor of claim 12, wherein said suction hole opens directly between said lubricant oil pooling portion and an interior of said throttle section.

18. The reciprocating compressor of claim 12, wherein said throttle section constitutes a lower portion of a cap that is secured to a lower end of said crankshaft; and said cap comprises a cylinder having a hollow cylindrical interior connecting with said hollow cylinder extending upward from said lower end of said crankshaft, said hollow cylindrical interior of said cap being terminated, at a bottom end thereof, by said bottom wall having said suction hole formed therein.

19. The reciprocating compressor of claim 12, wherein said second part of said vent hole is inclined with respect to said first part of said vent hole.

* * * * *

UNITED STATES PATENT AND TRADEMARK OFFICE

CERTIFICATE OF CORRECTION

PATENT NO. : 7,631,729 B2
APPLICATION NO. : 10/687825
DATED : December 15, 2009
INVENTOR(S) : Koichi Tsuchiya et al.

It is certified that error appears in the above-identified patent and that said Letters Patent is hereby corrected as shown below:

In column 8, lines 52-54 (claim 12, lines 20-22), "wherein a lower, mail bearing is provided about said mail section of said crankshaft to rotatably support said crankshaft at said main section thereof;" should read -- wherein a lower, main bearing is provided about said main section of said crankshaft to rotatably support said crankshaft at said main section thereof; --.

Signed and Sealed this

Eighteenth Day of May, 2010

David J. Kappos

David J. Kappos
*Director of the United States Patent and Trademark Office*